US009470223B2

(12) United States Patent
Mallampalli et al.

(10) Patent No.: US 9,470,223 B2
(45) Date of Patent: Oct. 18, 2016

(54) METHOD FOR MONITORING A LINEAR COMPRESSOR

(71) Applicant: General Electric Company, Schenectady, NY (US)

(72) Inventors: Srinivas Mallampalli, Bangalore (IN); Abhijeet Bhandwale, Louisville, KY (US); Srujan Kusumba, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 332 days.

(21) Appl. No.: 14/177,026

(22) Filed: Feb. 10, 2014

(65) Prior Publication Data

US 2015/0226195 A1 Aug. 13, 2015

(51) Int. Cl.

| | |
|---|---|
| ***F04B 49/06*** | (2006.01) |
| ***F04B 35/00*** | (2006.01) |
| ***F04B 35/04*** | (2006.01) |

(52) U.S. Cl.

CPC ..... *F04B 49/06* (2013.01); *F04B 35/045* (2013.01)

(58) Field of Classification Search

CPC .... F04B 17/04; F04B 17/042; F04B 17/044; F04B 35/045; F04B 2203/0401; F04B 2203/0402; H02K 33/16

See application file for complete search history.

(56) References Cited

U.S. PATENT DOCUMENTS

| | | | | |
|---|---|---|---|---|
| 5,146,124 | A | 9/1992 | Higham et al. | |
| 5,525,845 | A | 6/1996 | Beale et al. | |
| 5,944,302 | A | 8/1999 | Loc et al. | |
| 6,812,597 | B2 | 11/2004 | McGill et al. | |
| 6,946,754 | B2 | 9/2005 | Inagaki et al. | |
| 7,614,856 | B2 | 11/2009 | Inagaki et al. | |
| 7,618,243 | B2 | 11/2009 | Tian et al. | |
| 8,011,183 | B2 | 9/2011 | Berchowitz | |
| 8,127,560 | B2 | 3/2012 | Dicken | |
| 8,177,523 | B2 | 5/2012 | Patel et al. | |
| 8,241,015 | B2 | 8/2012 | Lillie et al. | |
| 2004/0236494 | A1 * | 11/2004 | DeBotton | G01M 15/12 701/111 |
| 2006/0171822 | A1 | 8/2006 | Seagar et al. | |
| 2009/0039655 | A1 | 2/2009 | Berchowitz | |
| 2009/0094977 | A1 | 4/2009 | Hill | |
| 2009/0263262 | A1 | 10/2009 | McGill | |
| 2011/0056196 | A1 | 3/2011 | Berchowitz et al. | |
| 2011/0058960 | A1 | 3/2011 | Bernhard Lilie et al. | |

(Continued)

FOREIGN PATENT DOCUMENTS

| | | | |
|---|---|---|---|
| EP | 0620367 | 4/1993 | |
| WO | WO 0079671 A1 * | 12/2000 | F04B 35/045 |
| WO | WO 2005/028841 | 3/2005 | |

(Continued)

OTHER PUBLICATIONS

Mehta, V.K., Principle of Electrical Engineering and Electronics, Jan. 1, 2006, S Chand, 2nd Ed., p. 275-277.*

*Primary Examiner* — Peter J Bertheaud
*Assistant Examiner* — Thomas Cash
(74) *Attorney, Agent, or Firm* — Dority & Manning, P.A.

(57) ABSTRACT

A method for monitoring a linear compressor is provided. The method includes determining a velocity dependent induced voltage in a driving coil of the linear compressor, extracting a higher order harmonic from the velocity dependent induced voltage, and establishing that a piston of the linear compressor is crashing if the higher order harmonic is greater than a reference value.

16 Claims, 12 Drawing Sheets

(56) References Cited

U.S. PATENT DOCUMENTS

| | | | | |
|---|---|---|---|---|
| 2011/0103973 | A1* | 5/2011 | Dainez | F04B 35/045 417/44.1 |
| 2012/0177513 | A1 | 7/2012 | Lilie et al. | |

FOREIGN PATENT DOCUMENTS

| | | |
|---|---|---|
| WO | WO 2006/013377 | 2/2006 |
| WO | WO 2006/081642 | 2/2006 |
| WO | WO 2013/003923 | 1/2013 |

* cited by examiner

METHOD FOR MONITORING A LINEAR COMPRESSOR

FIELD OF THE INVENTION

The present subject matter relates generally to linear compressors, e.g., for refrigerator appliances.

BACKGROUND OF THE INVENTION

Certain refrigerator appliances include sealed systems for cooling chilled chambers of the refrigerator appliances. The sealed systems generally include a compressor that generates compressed refrigerant during operation of the sealed systems. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. The driving coil receives a current that generates a force for sliding the piston forward and backward within a chamber. During motion of the piston within the chamber, the piston compresses refrigerant. Motion of the piston within the chamber is generally controlled such that the piston does not crash against another component of the linear compressor during motion of the piston within the chamber. Such head crashing can damage various components of the linear compressor, such as the piston or an associated cylinder.

While head crashing is preferably avoided, it can be difficult to monitor and/or detect head crashing. Certain methods for detecting head crashes within linear compressors monitor a slope of the voltage and/or current supplied to the driving coil over time in order to detect sudden changes or discontinuities in the slope. In such methods, the sudden changes or discontinuities in the slope are correlated to a head crash event. Such methods can be cumbersome. For example, such methods can require large amounts of memory for an associated processor to calculate the slope and/or detect the sudden changes or discontinuities in the slope. In addition, such methods can require knowledge of when the piston is approaching a top dead center position at the head of the cylinder.

Accordingly, a method for detecting or monitoring head crashing within a linear compressor during operation of the linear compressor would be useful. In particular, a method for that can quickly and/or efficiently detect or monitor head crashing within a linear compressor during operation of the linear compressor would be useful.

BRIEF DESCRIPTION OF THE INVENTION

The present subject matter provides a method for monitoring a linear compressor. The method includes determining a velocity dependent induced voltage in a driving coil of the linear compressor, extracting a higher order harmonic from the velocity dependent induced voltage, and establishing that a piston of the linear compressor is crashing if the higher order harmonic is greater than a reference value. Additional aspects and advantages of the invention will be set forth in part in the following description, or may be apparent from the description, or may be learned through practice of the invention.

In a first exemplary embodiment, a method for monitoring a linear compressor is provided. The method includes measuring a current and a voltage though a driving coil of the linear compressor, determining a velocity dependent induced voltage in the driving coil based at least in part on the current and voltage through the driving coil, extracting a higher order harmonic from the velocity dependent induced voltage, and establishing that a piston of the linear compressor is crashing if the higher order harmonic is greater than a reference value.

In a second exemplary embodiment, a linear compressor is provided. The linear compressor includes a cylinder assembly defining a chamber. A piston assembly has a piston head slidably received within the chamber of the cylinder assembly. The piston assembly also has a magnet. A driving coil is positioned adjacent the magnet of the piston assembly. A magnetic field of the driving coil engages the magnet of the piston assembly in order to move the piston within the chamber of the cylinder during operation of the driving coil. A controller is in operative communication with the driving coil. The controller is programmed for ascertaining a current and a voltage though the driving coil, determining a velocity dependent induced voltage in the driving coil based at least in part on the current and voltage through the driving coil, extracting a higher order harmonic from the velocity dependent induced voltage, and establishing that the piston is crashing if the higher order harmonic is greater than a reference value.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
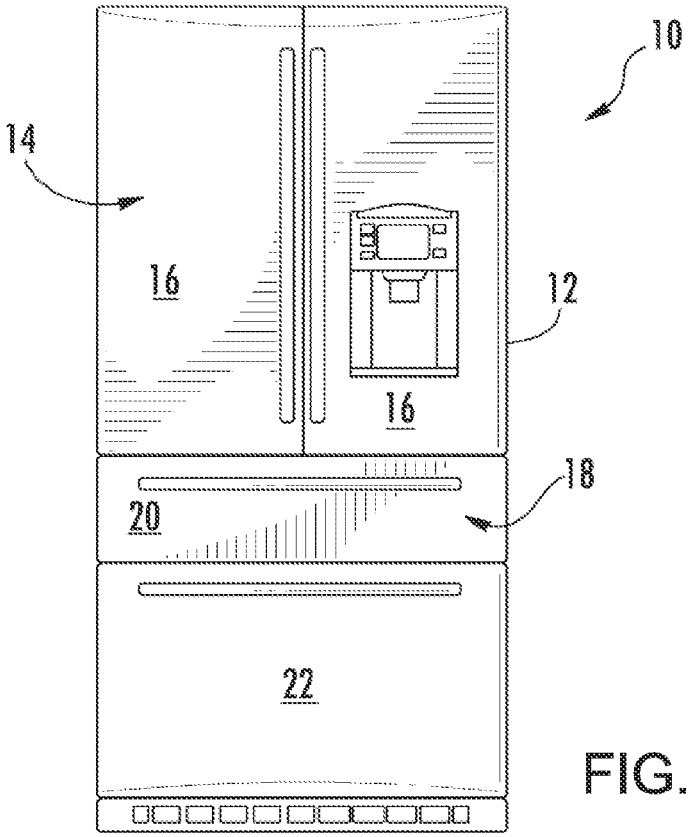
FIG. 1 is a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
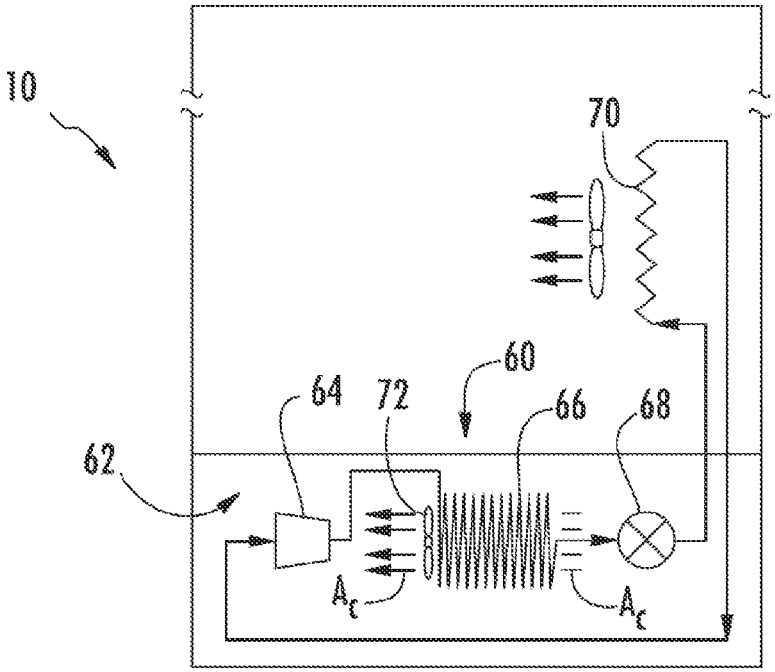
FIG. 2 is schematic view of certain components of the exemplary refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
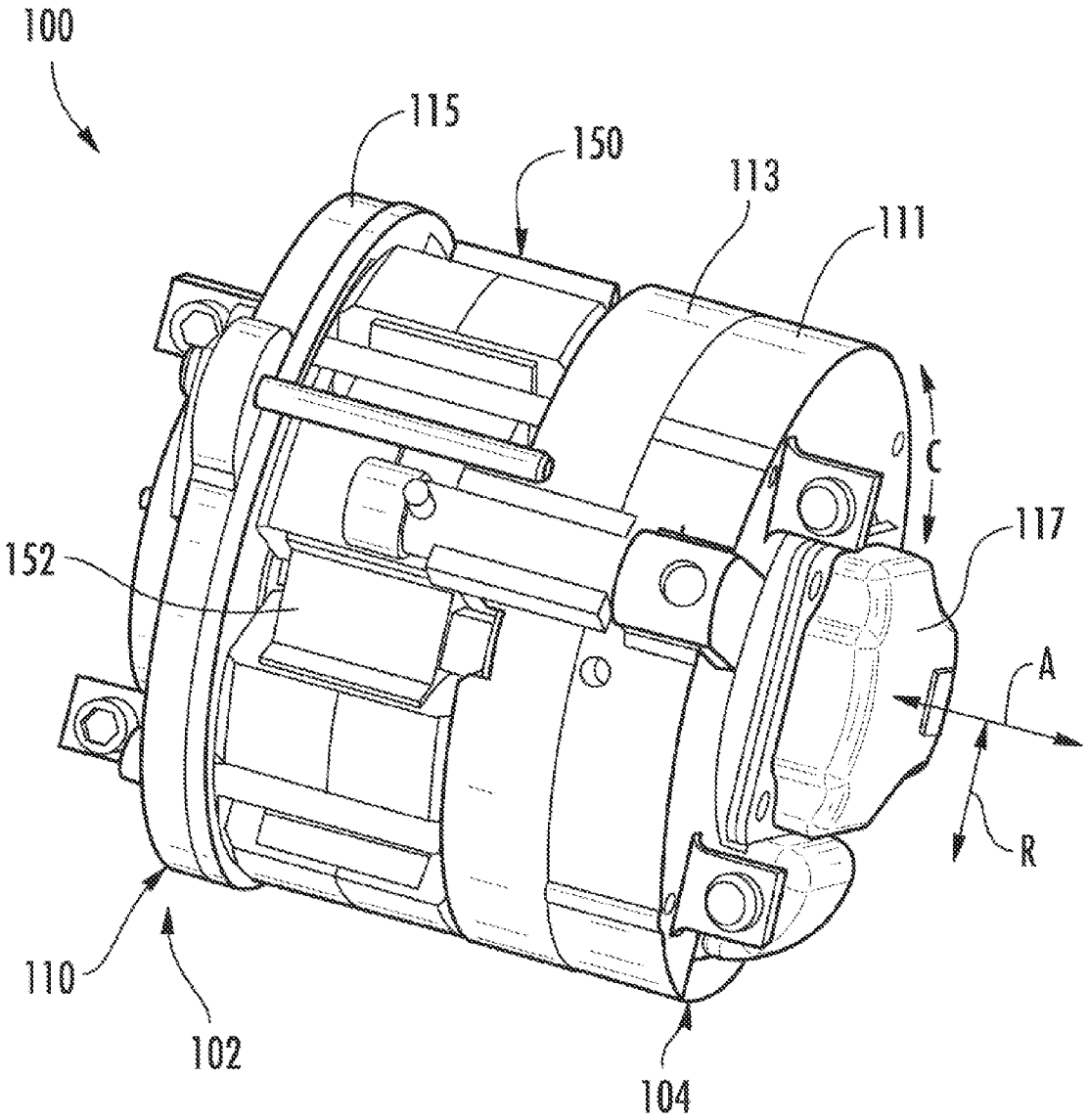
FIG. 3 provides a perspective view of a linear compressor according to an exemplary embodiment of the present subject matter.
Figure 4:
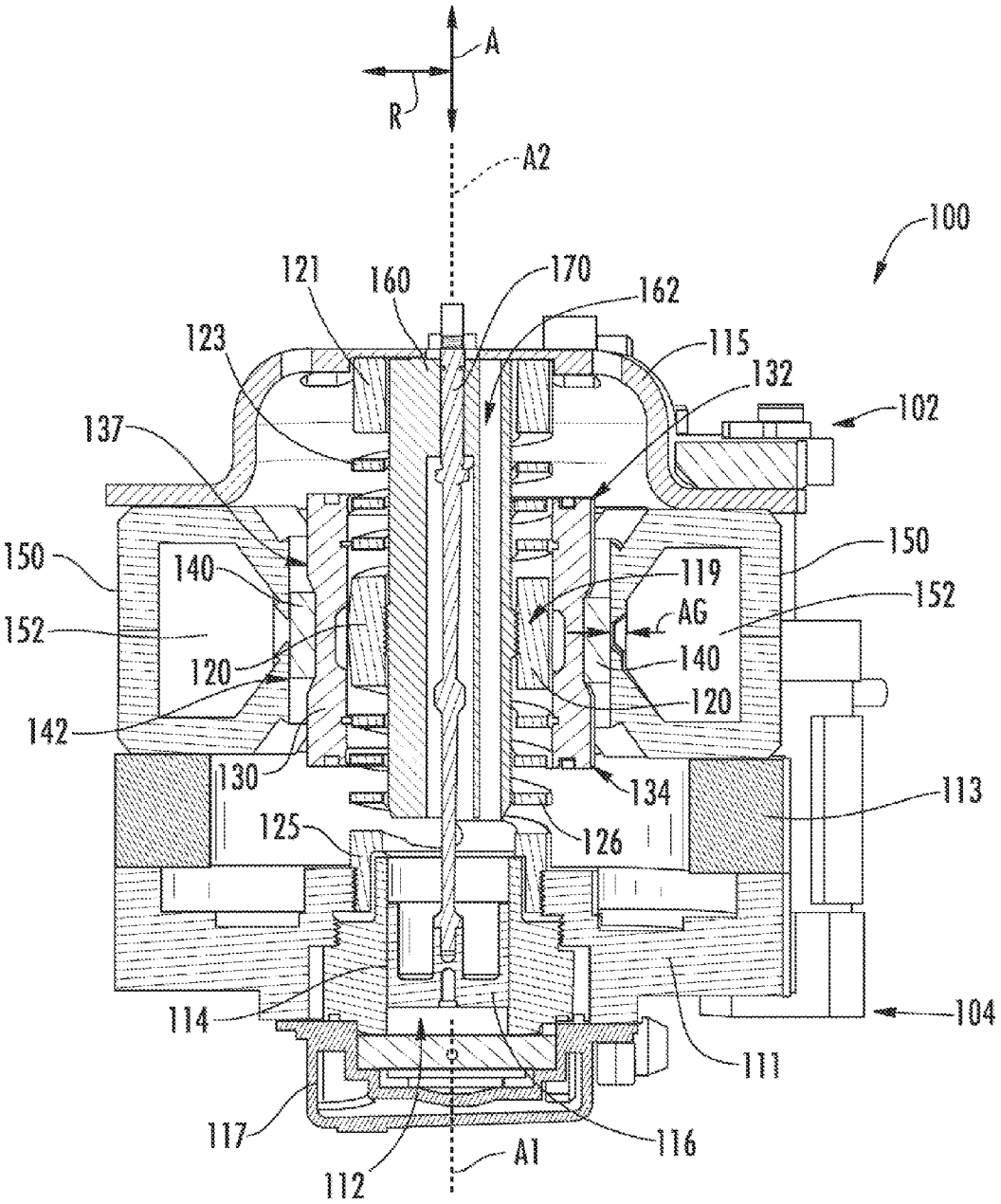
FIG. 4 provides a side section view of the exemplary linear compressor of FIG. 3.
Figure 5:
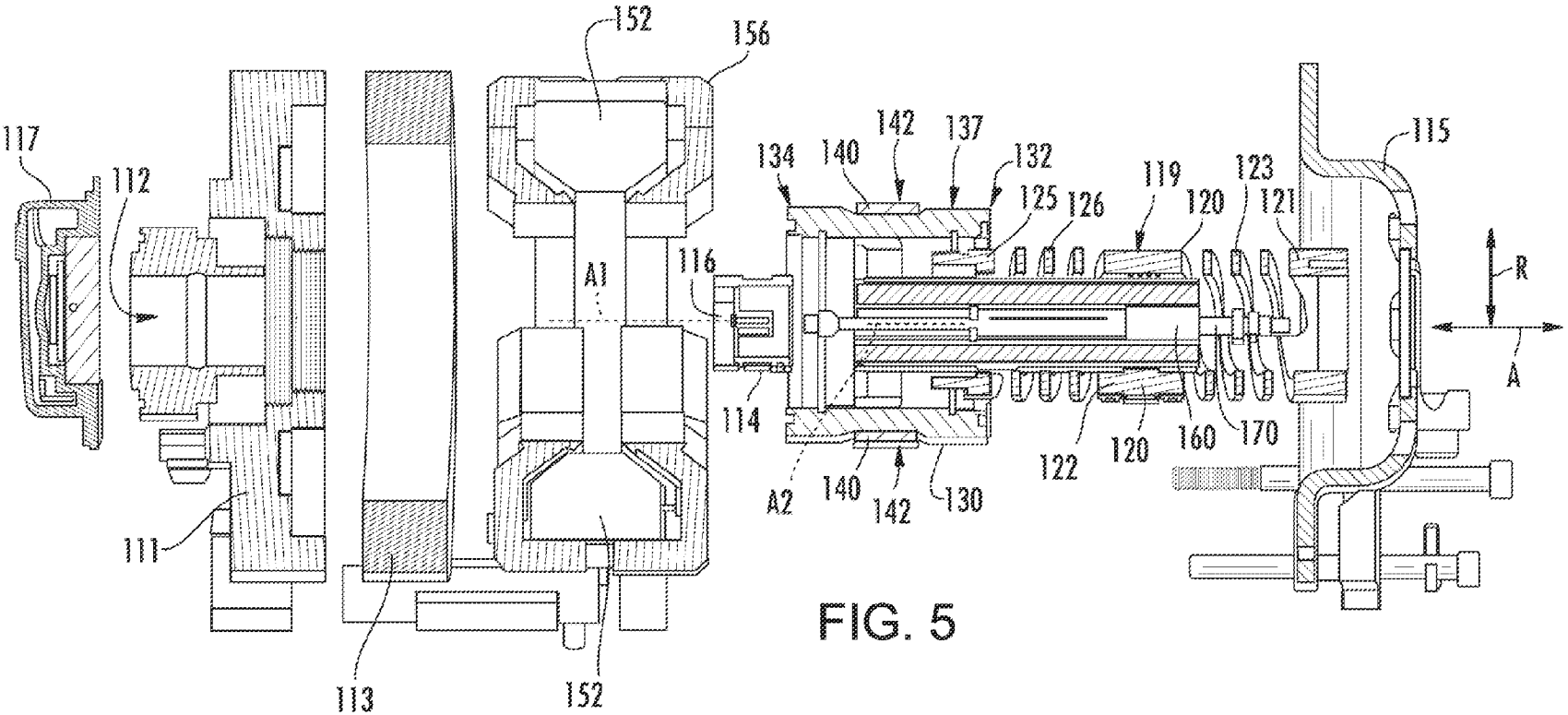
FIG. 5 provides an exploded view of the exemplary linear compressor of FIG. 4.

FIG. 3 provides a perspective view of a linear compressor 100 according to an exemplary embodiment of the present subject matter. FIG. 4 provides a side section view of linear compressor 100. FIG. 5 provides an exploded side section view of linear compressor 100. As discussed in greater detail below, linear compressor 100 is operable to increase a pressure of fluid within a chamber 112 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2). As may be seen in FIG. 3, linear compressor 100 defines an axial direction A, a radial direction R and a circumferential direction C. Linear compressor 100 may be enclosed within a hermetic or air-tight shell (not shown). The hermetic shell can, e.g., hinder or prevent refrigerant from leaking or escaping from refrigeration system 60.

Turning now to FIG. 4, linear compressor 100 includes a casing 110 that extends between a first end portion 102 and a second end portion 104, e.g., along the axial direction A. Casing 110 includes various static or non-moving structural components of linear compressor 100. In particular, casing 110 includes a cylinder assembly 111 that defines a chamber 112. Cylinder assembly 111 is positioned at or adjacent second end portion 104 of casing 110. Chamber 112 extends longitudinally along the axial direction A. Casing 110 also includes a motor mount mid-section 113 and an end cap 115 positioned opposite each other about a motor. A stator, e.g., including an outer back iron 150 and a driving coil 152, of the motor is mounted or secured to casing 110, e.g., such that the stator is sandwiched between motor mount mid-section 113 and end cap 115 of casing 110. Linear compressor 100 also includes valves (such as a discharge valve assembly 117 at an end of chamber 112) that permit refrigerant to enter and exit chamber 112 during operation of linear compressor 100.

A piston assembly 114 with a piston head 116 is slidably received within chamber 112 of cylinder assembly 111. In particular, piston assembly 114 is slidable along a first axis A1 within chamber 112. The first axis A1 may be substantially parallel to the axial direction A. During sliding of piston head 116 within chamber 112, piston head 116 compresses refrigerant within chamber 112. As an example, from a top dead center position, piston head 116 can slide within chamber 112 towards a bottom dead center position along the axial direction A, i.e., an expansion stroke of piston head 116. When piston head 116 reaches the bottom dead center position, piston head 116 changes directions and slides in chamber 112 back towards the top dead center position, i.e., a compression stroke of piston head 116. It should be understood that linear compressor 100 may include an additional piston head and/or additional chamber at an opposite end of linear compressor 100. Thus, linear compressor 100 may have multiple piston heads in alternative exemplary embodiments.

Linear compressor 100 also includes an inner back iron assembly 130. Inner back iron assembly 130 is positioned in the stator of the motor. In particular, outer back iron 150 and/or driving coil 152 may extend about inner back iron assembly 130, e.g., along the circumferential direction C. Inner back iron assembly 130 extends between a first end portion 132 and a second end portion 134, e.g., along the axial direction A.

Inner back iron assembly 130 also has an outer surface 137. At least one driving magnet 140 is mounted to inner back iron assembly 130, e.g., at outer surface 137 of inner back iron assembly 130. Driving magnet 140 may face and/or be exposed to driving coil 152. In particular, driving magnet 140 may be spaced apart from driving coil 152, e.g., along the radial direction R by an air gap AG. Thus, the air gap AG may be defined between opposing surfaces of driving magnet 140 and driving coil 152. Driving magnet 140 may also be mounted or fixed to inner back iron assembly 130 such that an outer surface 142 of driving magnet 140 is substantially flush with outer surface 137 of inner back iron assembly 130. Thus, driving magnet 140 may be inset within inner back iron assembly 130. In such a manner, the magnetic field from driving coil 152 may have to pass through only a single air gap (e.g., air gap AG) between outer back iron 150 and inner back iron assembly 130 during operation of linear compressor 100, and linear compressor 100 may be more efficient than linear compressors with air gaps on both sides of a driving magnet.

As may be seen in FIG. 4, driving coil 152 extends about inner back iron assembly 130, e.g., along the circumferential direction C. Driving coil 152 is operable to move the inner back iron assembly 130 along a second axis A2 during operation of driving coil 152. The second axis may be substantially parallel to the axial direction A and/or the first axis A1. As an example, driving coil 152 may receive a current from a current source (not shown) in order to generate a magnetic field that engages driving magnet 140 and urges piston assembly 114 to move along the axial direction A in order to compress refrigerant within chamber 112 as described above and will be understood by those skilled in the art. In particular, the magnetic field of driving coil 152 may engage driving magnet 140 in order to move inner back iron assembly 130 along the second axis A2 and piston head 116 along the first axis A1 during operation of driving coil 152. Thus, driving coil 152 may slide piston assembly 114 between the top dead center position and the bottom dead center position, e.g., by moving inner back iron assembly 130 along the second axis A2, during operation of driving coil 152.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 152 of the motor. Thus, the controller may selectively activate driving coil 152, e.g., by supplying current to driving coil 152, in order to compress refrigerant with piston assembly 114 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Linear compressor 100 also includes a machined spring 120. Machined spring 120 is positioned in inner back iron assembly 130. In particular, inner back iron assembly 130 may extend about machined spring 120, e.g., along the circumferential direction C. Machined spring 120 also extends between first and second end portions 102 and 104 of casing 110, e.g., along the axial direction A. Machined spring 120 assists with coupling inner back iron assembly 130 to casing 110, e.g., cylinder assembly 111 of casing 110. In particular, inner back iron assembly 130 is fixed to machined spring 120 at a middle portion 119 of machined spring 120 as discussed in greater detail below.

During operation of driving coil 152, machined spring 120 supports inner back iron assembly 130. In particular, inner back iron assembly 130 is suspended by machined spring 120 within the motor such that motion of inner back iron assembly 130 along the radial direction R is hindered or limited while motion along the second axis A2 is relatively unimpeded. Thus, machined spring 120 may be substantially stiffer along the radial direction R than along the axial direction A. In such a manner, machined spring 120 can assist with maintaining a uniformity of the air gap AG between driving magnet 140 and driving coil 152, e.g., along the radial direction R, during operation of the motor and movement of inner back iron assembly 130 on the second axis A2. Machined spring 120 can also assist with hindering side pull forces of the motor from transmitting to piston assembly 114 and being reacted in cylinder assembly 111 as a friction loss.

Figure 6:
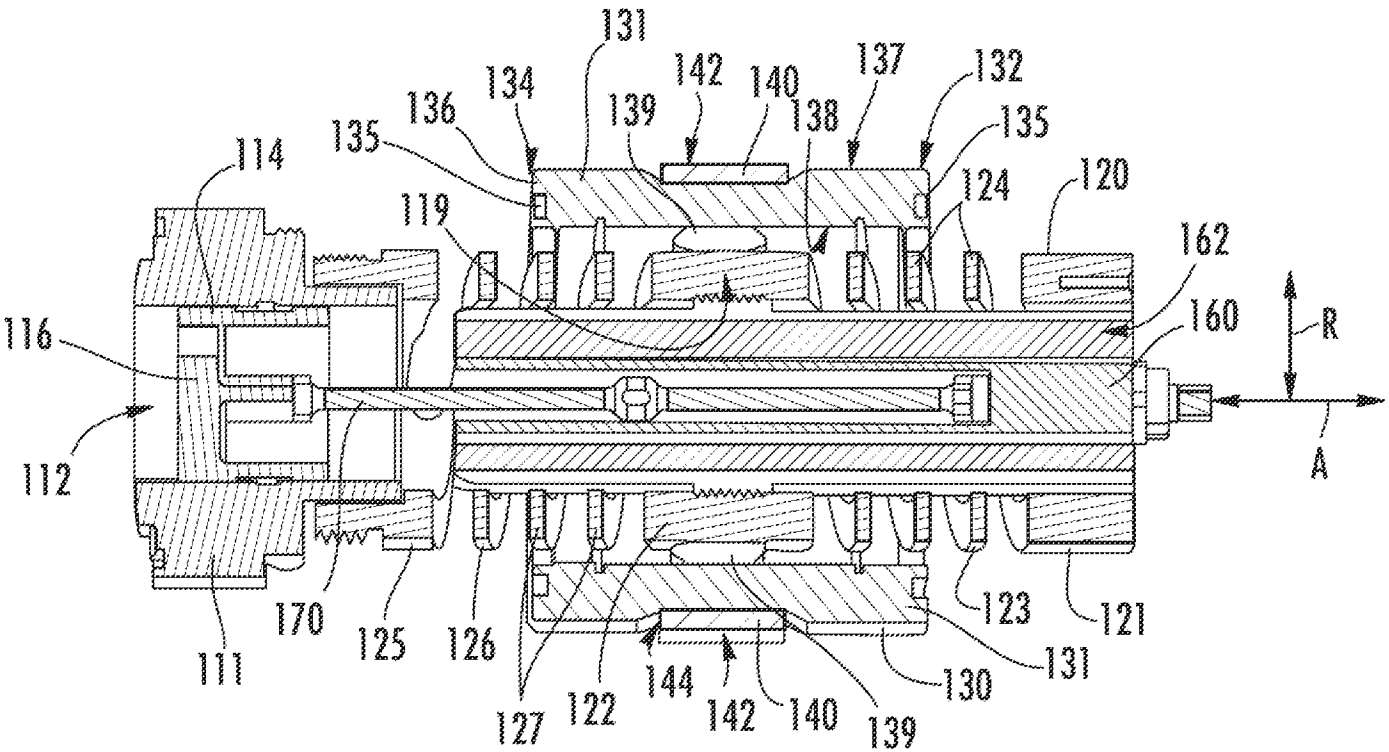
FIG. 6 provides a side section view of certain components of the exemplary linear compressor of FIG. 3.
Figure 7:
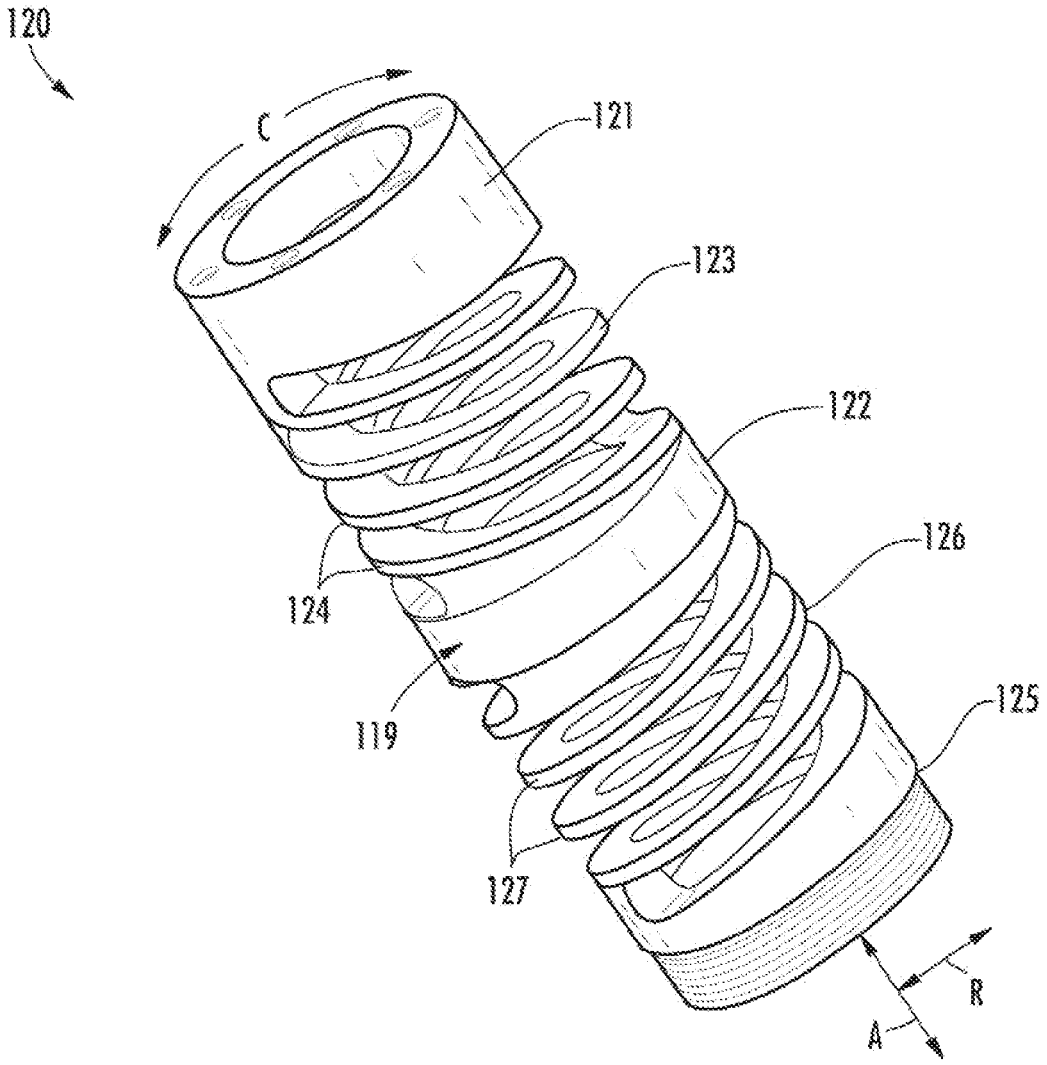
FIG. 7 provides a perspective view of a machined spring of the exemplary linear compressor of FIG. 3.

FIG. 6 provides a side section view of certain components of linear compressor 100. FIG. 7 provides a perspective view of machined spring 120. As may be seen in FIG. 7, machined spring 120 includes a first cylindrical portion 121, a second cylindrical portion 122, a first helical portion 123, a third cylindrical portion 125 and a second helical portion 126. First helical portion 123 of machined spring 120 extends between and couples first and second cylindrical portions 121 and 122 of machined spring 120, e.g., along the axial direction A. Similarly, second helical portion 126 of machined spring 120 extends between and couples second and third cylindrical portions 122 and 125 of machined spring 120, e.g., along the axial direction A.

Turning back to FIG. 4, first cylindrical portion 121 is mounted or fixed to casing 110 at first end portion 102 of casing 110. Thus, first cylindrical portion 121 is positioned at or adjacent first end portion 102 of casing 110. Third cylindrical portion 125 is mounted or fixed to casing 110 at second end portion 104 of casing 110, e.g., to cylinder assembly 111 of casing 110. Thus, third cylindrical portion 125 is positioned at or adjacent second end portion 104 of casing 110. Second cylindrical portion 122 is positioned at middle portion 119 of machined spring 120. In particular, second cylindrical portion 122 is positioned within and fixed to inner back iron assembly 130. Second cylindrical portion 122 may also be positioned equidistant from first and third cylindrical portions 121 and 125, e.g., along the axial direction A.

First cylindrical portion 121 of machined spring 120 is mounted to casing 110 with fasteners (not shown) that extend though end cap 115 of casing 110 into first cylindrical portion 121. In alternative exemplary embodiments, first cylindrical portion 121 of machined spring 120 may be threaded, welded, glued, fastened, or connected via any other suitable mechanism or method to casing 110. Third cylindrical portion 125 of machined spring 120 is mounted to cylinder assembly 111 at second end portion 104 of casing 110 via a screw thread of third cylindrical portion 125 threaded into cylinder assembly 111. In alternative exemplary embodiments, third cylindrical portion 125 of machined spring 120 may be welded, glued, fastened, or connected via any other suitable mechanism or method, such as an interference fit, to casing 110.

As may be seen in FIG. 7, first helical portion 123 extends, e.g., along the axial direction A, between first and second cylindrical portions 121 and 122 and couples first and second cylindrical portions 121 and 122 together. Similarly, second helical portion 126 extends, e.g., along the axial direction A, between second and third cylindrical portions 122 and 125 and couples second and third cylindrical portions 122 and 125 together. Thus, second cylindrical portion 122 is suspended between first and third cylindrical portions 121 and 125 with first and second helical portions 123 and 126.

First and second helical portions 123 and 126 and first, second and third cylindrical portions 121, 122 and 125 of machined spring 120 may be continuous with one another and/or integrally mounted to one another. As an example, machined spring 120 may be formed from a single, continuous piece of metal, such as steel, or other elastic material. In addition, first, second and third cylindrical portions 121, 122 and 125 and first and second helical portions 123 and 126 of machined spring 120 may be positioned coaxially relative to one another, e.g., on the second axis A2.

First helical portion 123 includes a first pair of helices 124. Thus, first helical portion 123 may be a double start helical spring. Helical coils of first helices 124 are separate from each other. Each helical coil of first helices 124 also extends between first and second cylindrical portions 121 and 122 of machined spring 120. Thus, first helices 124 couple first and second cylindrical portions 121 and 122 of machined spring 120 together. In particular, first helical portion 123 may be formed into a double-helix structure in which each helical coil of first helices 124 is wound in the same direction and connect first and second cylindrical portions 121 and 122 of machined spring 120.

Second helical portion 126 includes a second pair of helices 127. Thus, second helical portion 126 may be a double start helical spring. Helical coils of second helices 127 are separate from each other. Each helical coil of second helices 127 also extends between second and third cylindrical portions 122 and 125 of machined spring 120. Thus, second helices 127 couple second and third cylindrical portions 122 and 125 of machined spring 120 together. In particular, second helical portion 126 may be formed into a double-helix structure in which each helical coil of second helices 127 is wound in the same direction and connect second and third cylindrical portions 122 and 125 of machined spring 120.

By providing first and second helices 124 and 127 rather than a single helix, a force applied by machined spring 120 may be more even and/or inner back iron assembly 130 may rotate less during motion of inner back iron assembly 130 along the second axis A2. In addition, first and second helices 124 and 127 may be counter or oppositely wound. Such opposite winding may assist with further balancing the force applied by machined spring 120 and/or inner back iron assembly 130 may rotate less during motion of inner back iron assembly 130 along the second axis A2. In alternative exemplary embodiments, first and second helices 124 and 127 may include more than two helices. For example, first and second helices 124 and 127 may each include three helices, four helices, five helices or more.

By providing machined spring 120 rather than a coiled wire spring, performance of linear compressor 100 can be improved. For example, machined spring 120 may be more reliable than comparable coiled wire springs. In addition, the stiffness of machined spring 120 along the radial direction R may be greater than that of comparable coiled wire springs. Further, comparable coiled wire springs include an inherent unbalanced moment. Machined spring 120 may be formed to eliminate or substantially reduce any inherent unbalanced moments. As another example, adjacent coils of a comparable coiled wire spring contact each other at an end of the coiled wire spring, and such contact may dampen motion of the coiled wire spring thereby negatively affecting a performance of an associated linear compressor. In contrast, by being formed of a single continuous material and having no contact between adjacent coils, machined spring 120 may have less dampening than comparable coiled wire springs.

As may be seen in FIG. 6, inner back iron assembly 130 includes an outer cylinder 136 and a sleeve 139. Outer cylinder 136 defines outer surface 137 of inner back iron assembly 130 and also has an inner surface 138 positioned opposite outer surface 137 of outer cylinder 136. Sleeve 139 is positioned on or at inner surface 138 of outer cylinder 136. A first interference fit between outer cylinder 136 and sleeve 139 may couple or secure outer cylinder 136 and sleeve 139 together. In alternative exemplary embodiments, sleeve 139 may be welded, glued, fastened, or connected via any other suitable mechanism or method to outer cylinder 136.

Sleeve 139 extends about machined spring 120, e.g., along the circumferential direction C. In addition, middle portion 119 of machined spring 120 (e.g., third cylindrical portion 125) is mounted or fixed to inner back iron assembly 130 with sleeve 139. As may be seen in FIG. 6, sleeve 139 extends between inner surface 138 of outer cylinder 136 and middle portion 119 of machined spring 120, e.g., along the radial direction R. In particular, sleeve 139 extends between inner surface 138 of outer cylinder 136 and second cylindrical portion 122 of machined spring 120, e.g., along the radial direction R. A second interference fit between sleeve 139 and middle portion 119 of machined spring 120 may couple or secure sleeve 139 and middle portion 119 of machined spring 120 together. In alternative exemplary embodiments, sleeve 139 may be welded, glued, fastened, or connected via any other suitable mechanism or method to middle portion 119 of machined spring 120 (e.g., second cylindrical portion 122 of machined spring 120).

Outer cylinder 136 may be constructed of or with any suitable material. For example, outer cylinder 136 may be constructed of or with a plurality of (e.g., ferromagnetic) laminations 131. Laminations 131 are distributed along the circumferential direction C in order to form outer cylinder 136. Laminations 131 are mounted to one another or secured together, e.g., with rings 135 at first and second end portions 132 and 134 of inner back iron assembly 130. Outer cylinder 136, e.g., laminations 131, define a recess 144 that extends inwardly from outer surface 137 of outer cylinder 136, e.g., along the radial direction R. Driving magnet 140 is positioned in recess 144, e.g., such that driving magnet 140 is inset within outer cylinder 136.

A piston flex mount 160 is mounted to and extends through inner back iron assembly 130. In particular, piston flex mount 160 is mounted to inner back iron assembly 130 via sleeve 139 and machined spring 120. Thus, piston flex mount 160 may be coupled (e.g., threaded) to machined spring 120 at second cylindrical portion 122 of machined spring 120 in order to mount or fix piston flex mount 160 to inner back iron assembly 130. A coupling 170 extends between piston flex mount 160 and piston assembly 114, e.g., along the axial direction A. Thus, coupling 170 connects inner back iron assembly 130 and piston assembly 114 such that motion of inner back iron assembly 130, e.g., along the axial direction A or the second axis A2, is transferred to piston assembly 114.

Figure 10:
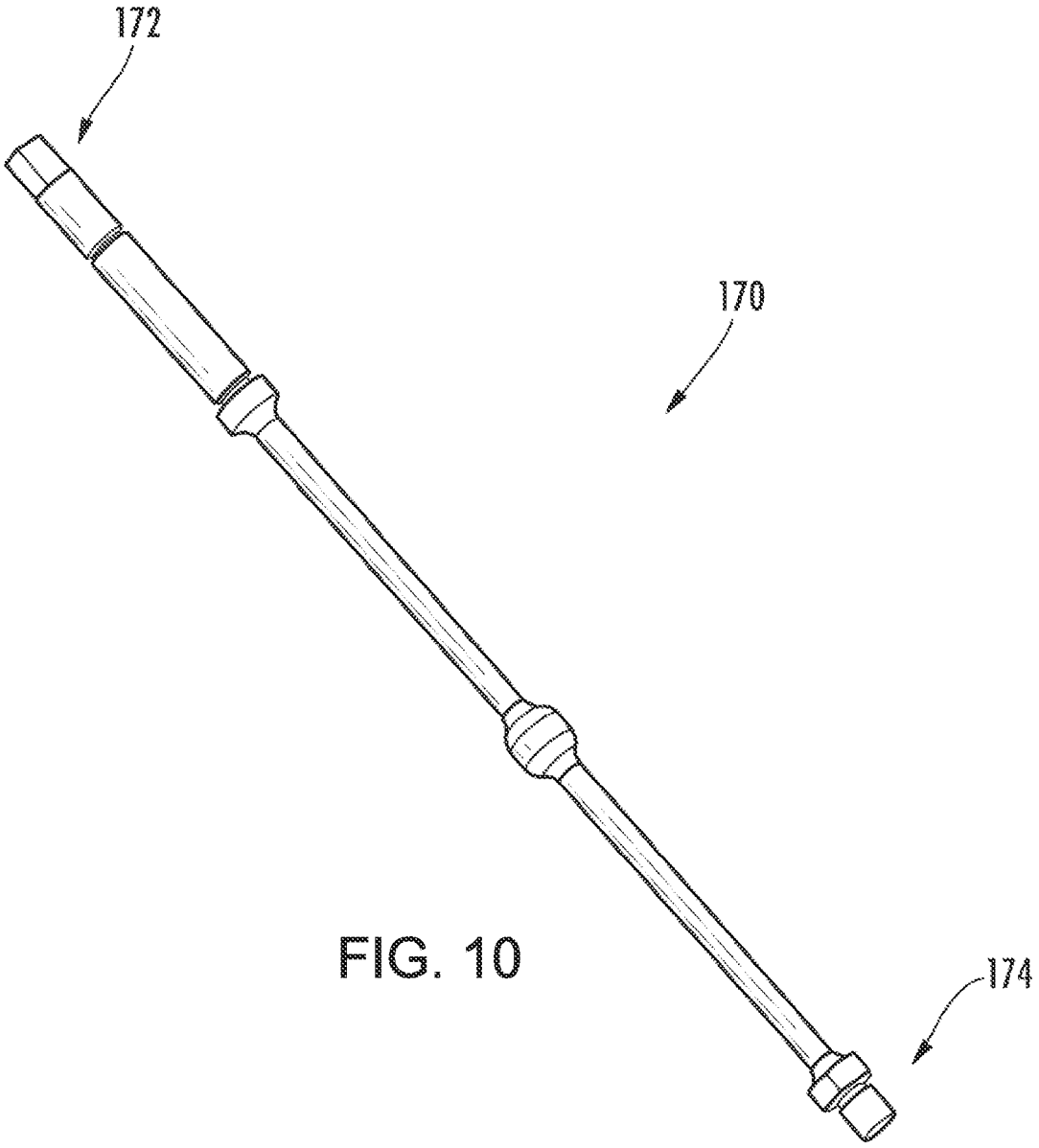
FIG. 10 provides a perspective view of a coupling of the exemplary linear compressor of FIG. 3.

FIG. 10 provides a perspective view of coupling 170. As may be seen in FIG. 10, coupling 170 extends between a first end portion 172 and a second end portion 174, e.g., along the axial direction A. Turning back to FIG. 6, first end portion 172 of coupling 170 is mounted to the piston flex mount 160, and second end portion 174 of coupling 170 is mounted to piston assembly 114. First and second end portions 172 and 174 of coupling 170 may be positioned at opposite sides of driving coil 152. In particular, coupling 170 may extend through driving coil 152, e.g., along the axial direction A.

Figure 8:
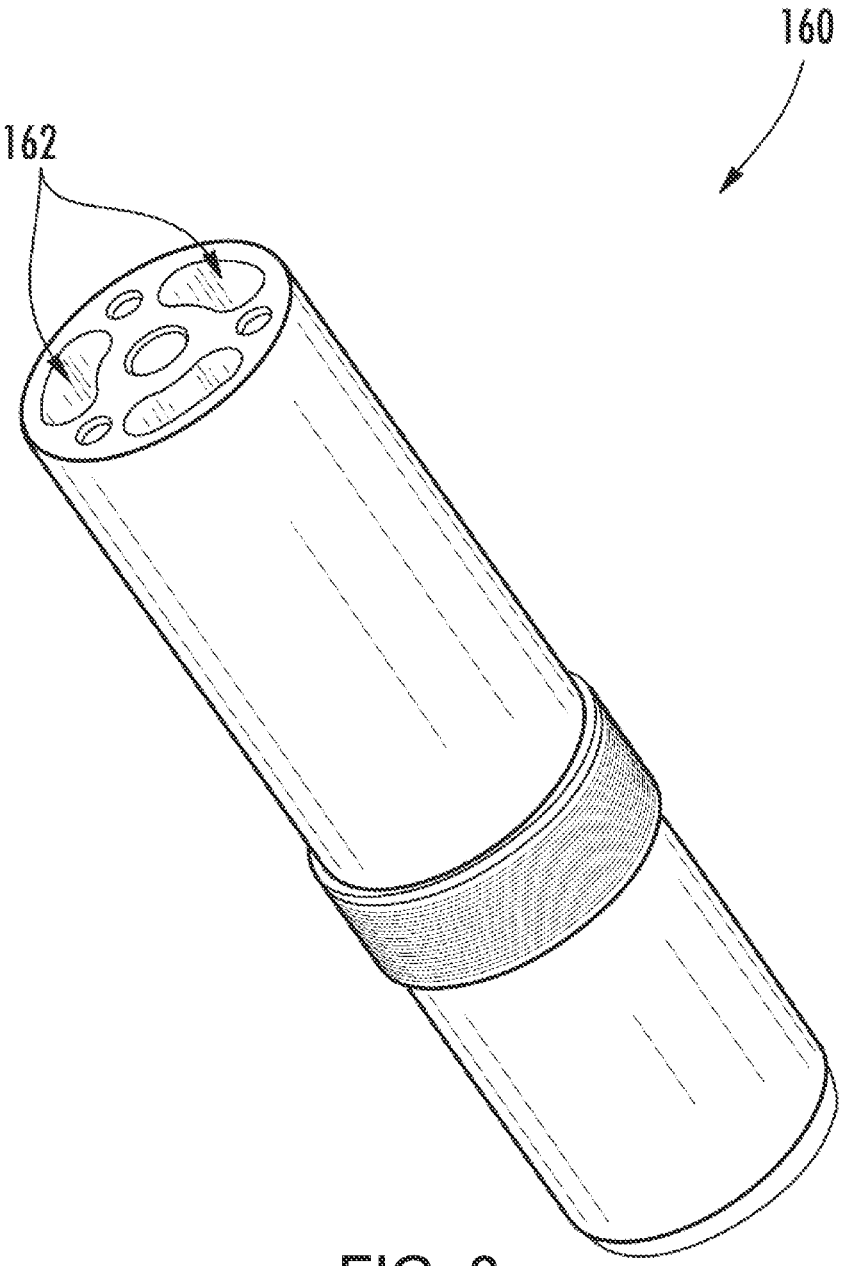
FIG. 8 provides a perspective view of a piston flex mount of the exemplary linear compressor of FIG. 3.
Figure 9:
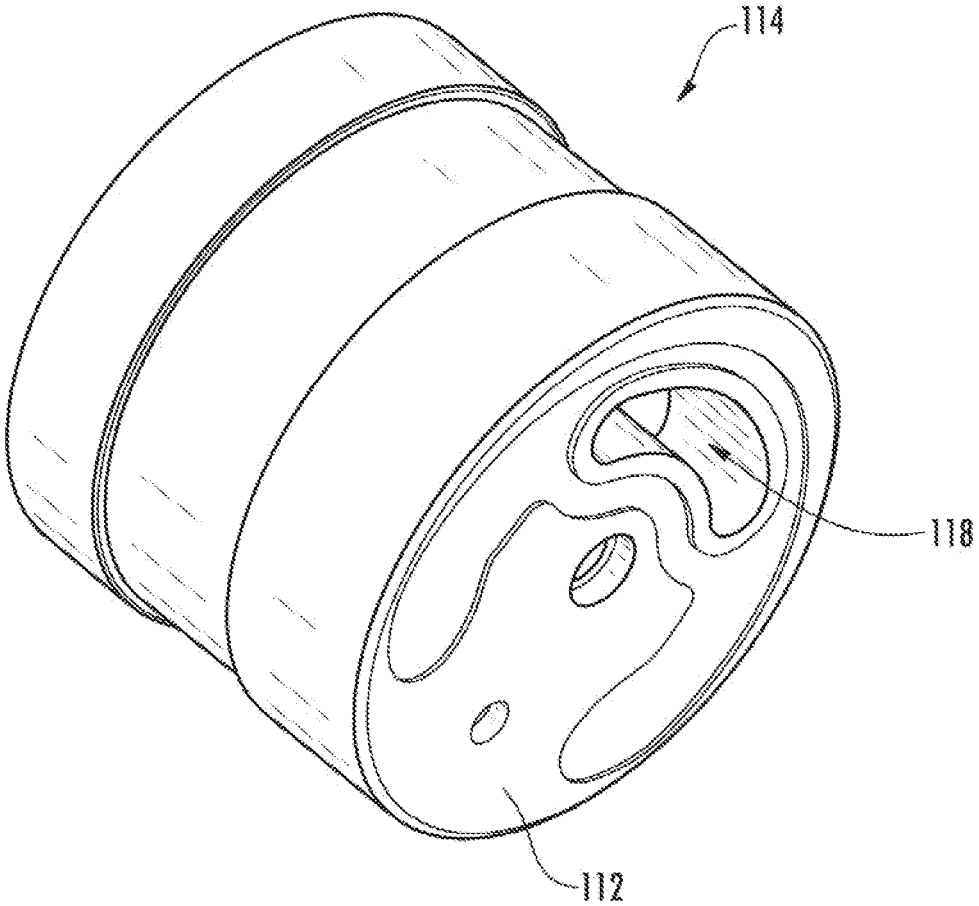
FIG. 9 provides a perspective view of a piston of the exemplary linear compressor of FIG. 3.

FIG. 8 provides a perspective view of piston flex mount 160. FIG. 9 provides a perspective view of piston assembly 114. As may be seen in FIG. 8, piston flex mount 160 defines at least one passage 162. Passage 162 of piston flex mount 160 extends, e.g., along the axial direction A, through piston flex mount 160. Thus, a flow of fluid, such as air or refrigerant, may pass though piston flex mount 160 via passage 162 of piston flex mount 160 during operation of linear compressor 100.

As may be seen in FIG. 9, piston head 116 also defines at least one opening 118. Opening 110 of piston head 116 extends, e.g., along the axial direction A, through piston head 116. Thus, the flow of fluid may pass though piston head 116 via opening 118 of piston head 116 into chamber 112 during operation of linear compressor 100. In such a manner, the flow of fluid (that is compressed by piston head 114 within chamber 112) may flow through piston flex mount 160 and inner back iron assembly 130 to piston assembly 114 during operation of linear compressor 100.

Figure 11:
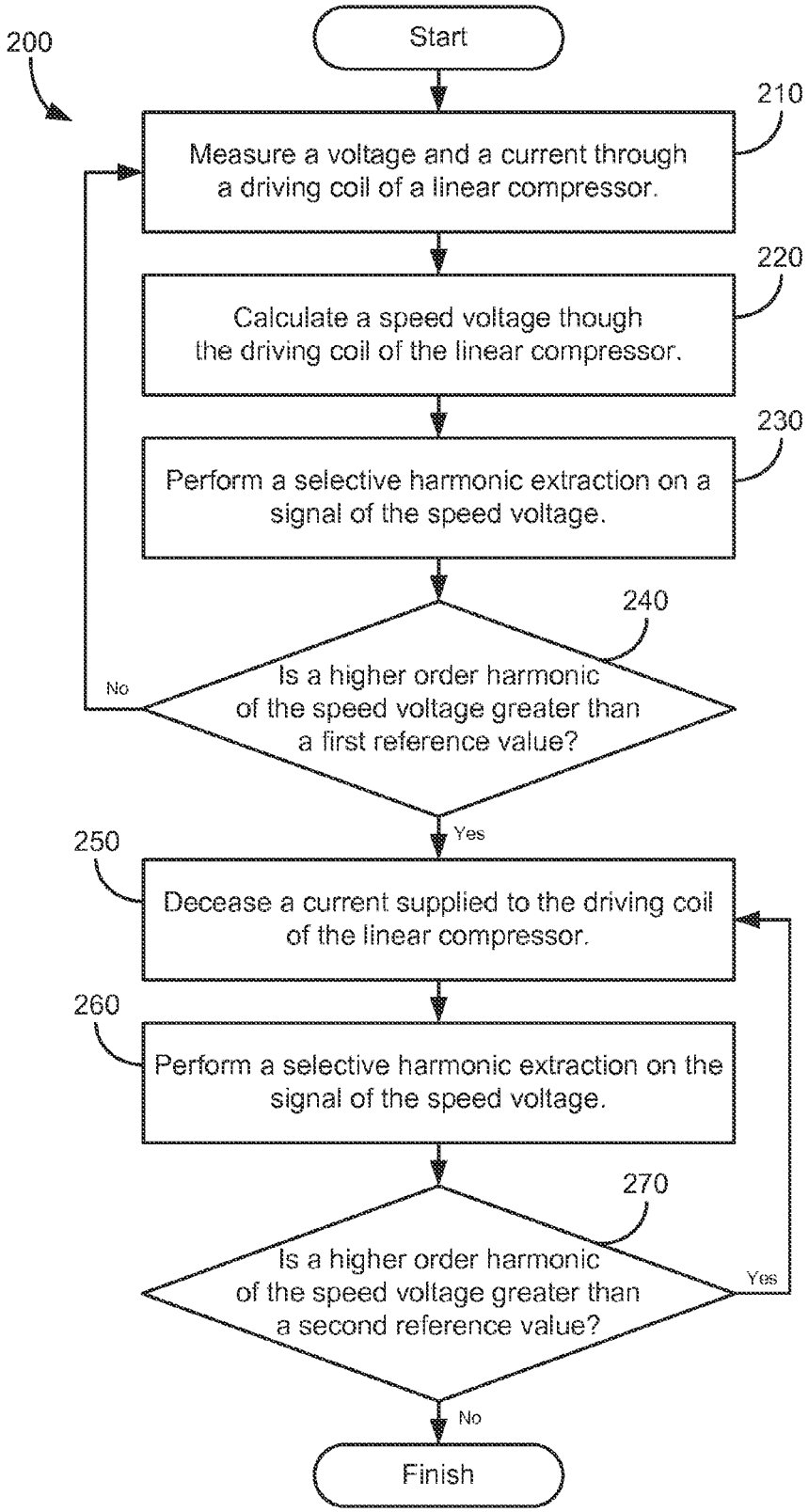
FIG. 11 illustrates a method for monitoring a linear compressor according to an exemplary embodiment of the present subject matter.

FIG. 11 illustrates a method 200 for monitoring a linear compressor according to an exemplary embodiment of the present subject matter. Method 200 may be used to monitor any suitable linear compressor. As an example, method 200 may be used to monitor linear compressor 100 (FIG. 3). The controller of linear compressor 100 may be programmed or configured to implement method 200. Utilizing method 200, crashing of piston 114, e.g., against cylinder assembly 111 and/or discharge valve 117, may be detected and/or monitored. Such crashing of piston 114 is generally referred to herein as "head crashing." Method 200 may also be used in linear compressor with stationary or static inner back irons.

At step 210, a current and/or a voltage though driving coil 152 of linear compressor 100 is measured or ascertained. As an example, the controller of linear compressor 100 may measure the current and/or the voltage though driving coil 152 at step 210. In particular, the controller or the motor may include a current and/or voltage measurement circuit for measuring the current and/or the voltage though driving coil 152 at step 210.

At step 220, a speed voltage or velocity dependent induced voltage in driving coil 152 is determined. The velocity dependent induced voltage in driving coil 152 may be generated or induced in driving coil 152 due to motion of driving magnet 140 relative to driving coil 152 during operation of linear compressor 100. The velocity dependent induced voltage in driving coil 152 may be determined based at least in part on the current and voltage through driving coil 152 at step 220. For example, the velocity dependent induced voltage in driving coil 152 may be determined with the following at step 220:

$$V_i\left(\frac{dx}{dt}\right) = V - iR - L\frac{di}{dt}$$

where $V_i(dx/dt)$ is the velocity dependent induced voltage in driving coil 152, V is the voltage through driving coil 152, e.g., measured at step 210, i is the current through driving coil 152, e.g., measured at step 210, R is a resistance of driving coil 152, L is an inductance of driving coil 152, and di/dt is a change in the current through driving coil 152 with respect to time.

Thus, the controller of linear compressor 100 may be programmed to utilize the above formula to determine the velocity dependent induced voltage in driving coil 152 at step 220. In particular, the controller of linear compressor 100 may be programmed to utilize the above formula to determine a signal of the velocity dependent induced voltage in driving coil 152 during a time interval at step 220.

Figure 12:
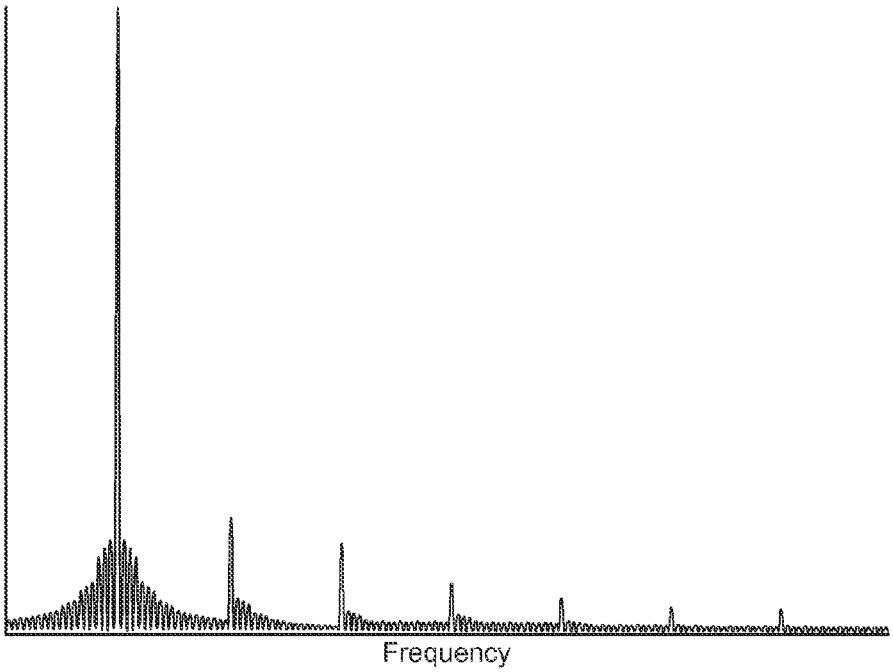
FIGS. 12 and 13 provide graphs of fast Fourier transforms of speed voltage signals from a linear compressor.
Figure 13:
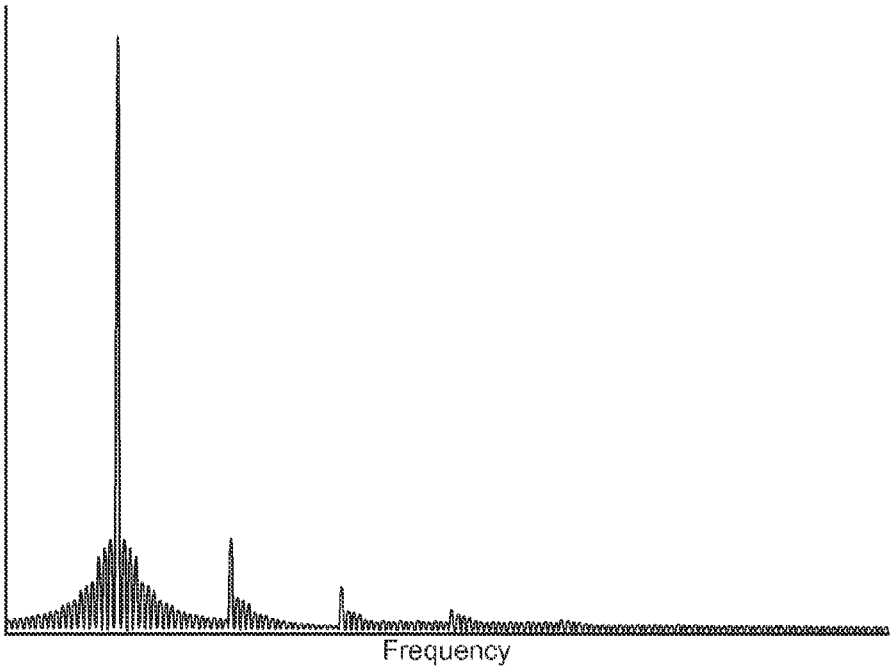

FIGS. 12 and 13 provide graphs of fast Fourier transforms of velocity dependent induced voltage in driving coil 152, e.g., from step 220. In FIG. 12, piston 112 of linear compressor 100 is crashing. Conversely, position 112 is not crashing in FIG. 13. As may be seen in FIGS. 12 and 13, a magnitude of higher order harmonics within the fast Fourier transforms of velocity dependent induced voltage in driving coil 152 are significantly greater when piston 114 is crashing, e.g., due to a velocity of piston 112 reducing to about zero during head crashing. As will be understood by those skilled in the art, fast Fourier transforms are memory intensive operations and can be difficult to continuously perform. Thus, method 200 includes steps for detecting head crashing, e.g., that do not require fast Fourier transforms and/or that require relatively small amounts of (e.g., the controller's) memory.

At step 230, a selective harmonic extraction is performed. In particular, a higher order harmonic is extracted from the velocity dependent induced voltage in driving coil 152 at step 230. As an example, the higher order harmonic may be extracted by multiplying the signal of the velocity dependent induced voltage in driving coil 152 from step 220 by a sinusoidal function (such as a sine or cosine function) having a frequency corresponding to the higher order harmonic. In addition, the controller may be programmed for integrating a product (of the signal of the velocity dependent induced voltage in driving coil 152 from step 220 and the sinusoidal function) over a period of a fundamental frequency of the signal of the velocity dependent induced voltage in driving coil 152 from step 220. In such a manner, the controller of linear compressor 100 may extract the higher order harmonic from the velocity dependent induced voltage in driving coil 152 at step 230.

Figure 14:
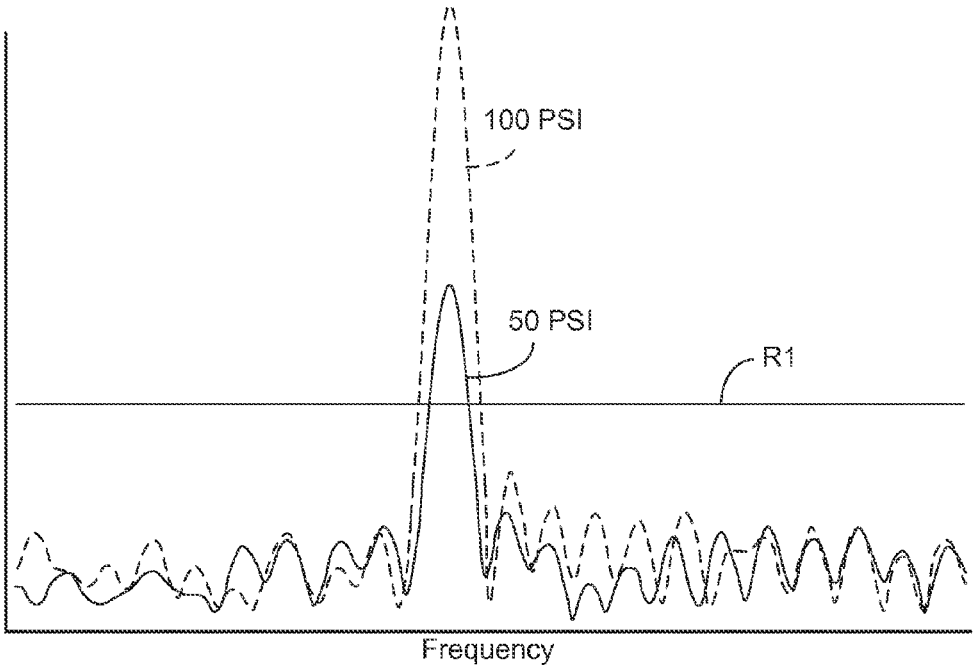
FIGS. 14 and 15 provide graphs of an extracted higher order harmonic of speed voltage signals from a linear compressor.
Figure 15:
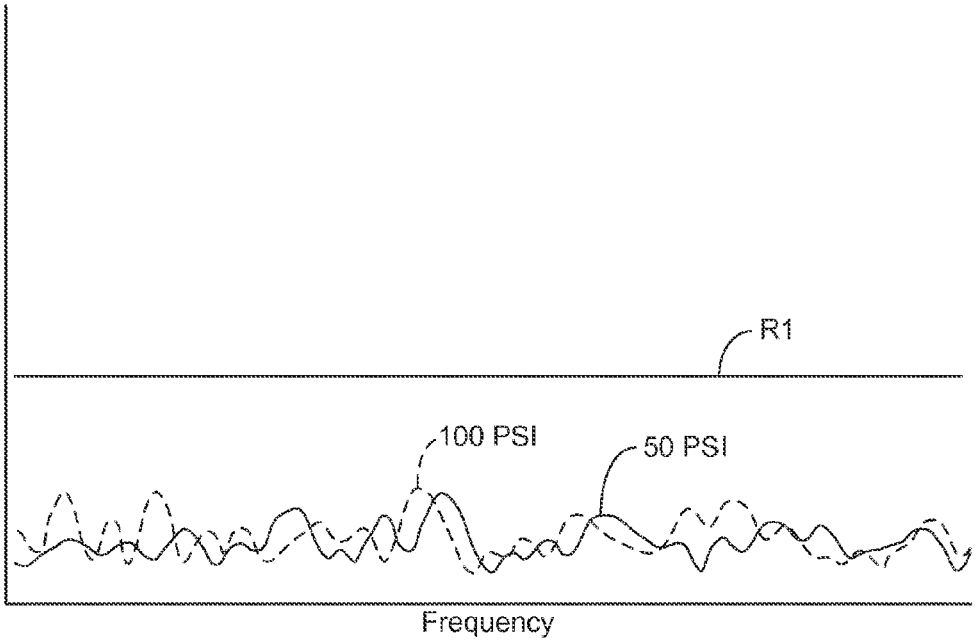

At step 240, a magnitude of the higher order harmonic is compared to a first reference value R1 (illustrated in FIGS. 14 and 15). At step 250, it is established (e.g., by the controller of linear compressor 100) that piston 114 is crashing if the higher order harmonic is greater than the first reference value R1 at step 240. Conversely, it is established (e.g., by the controller of linear compressor 100) that piston 114 is not crashing if the higher order harmonic is not greater than the first reference value R1 at step 240. Thus, when the higher order harmonic is present within the signal of the velocity dependent induced voltage in driving coil 152, the controller of linear compressor 100 may establish that piston 114 is crashing.

It should be understood that as used herein the term "higher order harmonic" corresponds to at least a third order harmonic. For example, the higher order harmonic may be a third order harmonic, a fourth order harmonic, a fifth order harmonic, a sixth order harmonic, etc. In certain exemplary embodiments, the higher order harmonic may be at least a fifth order harmonic. By selecting at least a third order harmonic rather than a lower order harmonic, method 200 can more accurately and/or precisely determine when piston 114 is crashing.

FIGS. 14 and 15 provide graphs of an extracted higher order harmonic of signals of velocity dependent induced voltage in driving coil 152. In FIG. 14, piston 114 is crashing. Conversely, piston 114 is not crashing in FIG. 15. As may be seen in FIGS. 14 and 15, the magnitude of the higher order harmonic is greater than the first reference value R1 when piston 114 is crashing (e.g., despite changes in a pressure within chamber 112 of cylinder assembly 111), and the magnitude of the higher order harmonic is not greater than the first reference value R1 when piston 114 is not crashing (e.g., despite changes in the pressure within chamber 112 of cylinder assembly 111). As will be understood by those skilled in the art, if piston 112 is not crashing, then the higher order harmonic will not be present (e.g., in a sufficient magnitude) within the within the signal of the velocity dependent induced voltage in driving coil 152. Thus, the integration of the product described above will integrate out to zero, e.g., due to the sinusoidal function.

At step 250, a current supplied to driving coil 152 is reduced if the higher order harmonic is greater than the first reference value R1 at step 240 and piston 114 is crashing. By reducing the current supplied to driving coil 152, the displacement of inner back iron assembly 130 and/or piston 112 along the axial direction A due to driving coil 152 may be reduced. Thus, the head crashing within linear compressor 100 may be stopped or diminished by reducing the current supplied to driving coil 152 at step 250. In particular, at step 250, the current supplied to driving coil 152 may be reduced until piston 114 is not crashing. The reduction in the current supplied to driving coil 152 at step 250 may be proportional to a difference between an amplitude of the higher order harmonic and the first reference value R1, e.g., due to such difference being indicative of a severity of the head crashing.

After reducing the current supplied to driving coil 152 at step 250, the selective harmonic extraction is performed again, and the higher order harmonic is extracted from the velocity dependent induced voltage in driving coil 152 at step 260. At step 270, the magnitude of the higher order harmonic is compared to a second reference value (e.g., zero or about equal to the first reference valve). If the higher order harmonic is greater than the second reference value at step 270, it is established that piston 114 is still crashing. Conversely, it is established (e.g., by the controller of linear compressor 100) that piston 114 is not crashing if the higher order harmonic is not greater than the second reference value at step 270.

Method 200 may also include adjusting the first reference value R1 based at least in part on the current supplied to driving coil 152 during step 250. For example, when piston 114 stops crashing, the current supplied to driving coil 152 during step 250 can be used to adjust the first reference value R1 such that the first reference value corresponds to a minimum magnitude of the higher order harmonic indicative of head crashing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for monitoring a linear compressor, comprising:

measuring a current and a voltage though a driving coil of the linear compressor;

determining a velocity dependent induced voltage in the driving coil based at least in part on the current and voltage through the driving coil;

extracting a higher order harmonic from the velocity dependent induced voltage, extracting the higher order harmonic comprising multiplying a signal of the velocity dependent induced voltage in the driving coil by a sinusoidal function having a frequency corresponding to the higher order harmonic and integrating a product from said step of multiplying over a period of a fundamental frequency of the signal of the velocity dependent induced voltage in the driving coil; and establishing that a piston of the linear compressor is crashing if the higher order harmonic is greater than a reference value.

2. The method of claim 1, wherein the higher order harmonic is at least a third order harmonic.

3. The method of claim 1, wherein the higher order harmonic is at least a fifth order harmonic.

4. The method of claim 1, wherein said step of determining comprises determining the velocity dependent induced voltage in the driving coil with the following:

$$V_i\left(\frac{dx}{dt}\right) = V - iR - L\frac{di}{dt}$$

where $V_i(dx/dt)$ is the velocity dependent induced voltage in the driving coil, V is the voltage through the driving coil, i is the current through the driving coil, R is a resistance of the driving coil, L is an inductance of the driving coil, and di/dt is a change in the current through the driving coil with respect to time.

5. The method of claim 1, further comprising reducing a current supplied to the driving coil if the higher order harmonic is greater than the reference value at said step of establishing.

6. The method of claim 5, further comprising repeating said steps of measuring, determining, extracting and establishing after said step of reducing.

7. The method of claim 1, wherein said step of establishing comprises establishing that the piston of the linear compressor is crashing if the higher order harmonic is greater than the reference value or that the piston of the linear compressor is not crashing if the higher order harmonic is less than the reference value.

8. The method of claim 1, further comprising reducing a current supplied to the driving coil until the piston of the linear compressor is not crashing; and adjusting the reference value based at least in part on the current supplied to the driving coil at said step of reducing.

9. A linear compressor, comprising:

a cylinder assembly defining a chamber;

a piston assembly having a piston head slidably received within the chamber of the cylinder assembly, the piston assembly also having a magnet;

a driving coil positioned adjacent the magnet of the piston assembly, a magnetic field of the driving coil engaging the magnet of the piston assembly in order to move the piston within the chamber of the cylinder during operation of the driving coil; and a controller in operative communication with the driving coil, the controller programmed for ascertaining a current and a voltage though the driving coil;

determining a velocity dependent induced voltage in the driving coil based at least in part on the current and voltage through the driving coil;

extracting a higher order harmonic from the velocity dependent induced voltage, extracting the higher order harmonic comprising multiplying a signal of the velocity dependent induced voltage in the driving coil by a sinusoidal function having a frequency corresponding to the higher order harmonic and integrating a product from said step of multiplying over a period of fundamental frequency of the signal of the velocity dependent induced voltage in the driving coil; and establishing that the piston is crashing if the higher order harmonic is greater than a reference value.

10. The linear compressor of claim 9, wherein the higher order harmonic is at least a third order harmonic.

11. The linear compressor of claim 9, wherein the higher order harmonic is at least a fifth order harmonic.

12. The linear compressor of claim 9, wherein said step of determining comprises determining the velocity dependent induced voltage in the driving coil with the following:

$$V_i\left(\frac{dx}{dt}\right) = V - iR - L\frac{di}{dt}$$

where $V_i(dx/dt)$ is the velocity dependent induced voltage in the driving coil, V is the voltage through the driving coil, i is the current through the driving coil, R is a resistance of the driving coil, L is an inductance of the driving coil, and di/dt is a change in the current through the driving coil with respect to time.

13. The linear compressor of claim 9, wherein the controller is further programmed for reducing a current supplied to the driving coil if the higher order harmonic is greater than the reference value at said step of establishing.

14. The linear compressor of claim 13, wherein the controller is further programmed for repeating said steps of measuring, determining, extracting and establishing after said step of reducing.

15. The linear compressor of claim 9, wherein said step of establishing comprises establishing that the piston is crashing if the higher order harmonic is greater than the reference value or that the piston is not crashing if the higher order harmonic is less than the reference value.

16. The linear compressor of claim 9, wherein the controller is further programmed for reducing a current supplied to the driving coil until the piston is not crashing; and adjusting the reference value based at least in part on the current supplied to the driving coil at said step of reducing.

* * * * *